United States Patent [19]

Luscombe

[11] Patent Number: 4,784,278

[45] Date of Patent: Nov. 15, 1988

[54] LOCK MECHANISM FOR CRANE DEVICE

[75] Inventor: Terry L. Luscombe, Armstrong, Iowa

[73] Assignee: TG Industries, Inc., Armstrong, Iowa

[21] Appl. No.: 15,672

[22] Filed: Feb. 17, 1987

[51] Int. Cl.[4] ..... B66F 11/04

[52] U.S. Cl. ..... 212/229; 74/531; 182/2; 188/72.9; 188/265

[58] Field of Search ..... 212/229; 182/2; 188/72.9, 265; 74/527, 531

[56] References Cited

U.S. PATENT DOCUMENTS

| | | | |
|---|---|---|---|
| 2,509,271 | 5/1950 | Jeffery | 74/531 |
| 2,950,121 | 8/1960 | Fisher | 188/265 |
| 3,146,853 | 9/1964 | Eckels | 182/2 |
| 3,196,979 | 7/1965 | Garnett | 182/2 |
| 3,467,217 | 9/1969 | Zwight | 182/2 |
| 3,590,948 | 7/1971 | Milner | 182/2 |
| 3,648,956 | 3/1972 | Paulson et al. | 212/229 |
| 3,727,722 | 4/1973 | Hedges et al. | 182/2 |
| 3,830,336 | 8/1974 | Reimbold et al. | 182/2 |
| 4,352,415 | 10/1982 | Powell | 188/72.9 |

FOREIGN PATENT DOCUMENTS

| | | | |
|---|---|---|---|
| 965976 | 10/1982 | U.S.S.R. | 212/229 |

*Primary Examiner*—Sherman D. Basinger
*Assistant Examiner*—Thomas J. Brahan
*Attorney, Agent, or Firm*—Herman H. Bains

[57] ABSTRACT

A crane apparatus is provided with a lock mechanism which releasably locks the pivot axle of the personnel bucket against pivotal movement relative to the upper boom arm. The pivot axle is affixed to the bucket and projects through and is journaled on the upper boom arm. Locking elements are affixed to the pivot axle and clamping elements are affixed to and mounted within the upper boom arm. A locking bolt is operable to cause the clamping elements to be clamped against the locking elements and to lock the pivot axle against pivotal movement relative to the upper boom arm.

2 Claims, 3 Drawing Sheets

4

LOCK MECHANISM FOR CRANE DEVICE

This invention relates to a crane apparatus and, more particularly, to a lock device for an occupant supporting bucket of the crane apparatus.

BACKGROUND OF THE INVENTION

Commercial vehicle mounted cranes are typically provided with a bucket or receptacle in which the operator is supported. The bucket is pivoted to the upper boom arm and freely pivots during adjustment of the crane. However, when the crane has been adjusted to a selected position, it is desirable to lock the bucket against pivotal movement relative to the upper boom arm in order to allow the operator to safely and effectively perform his task.

DESCRIPTION OF THE PRIOR ART

In certain prior art cranes, various lock devices have been developed for locking the bucket against pivotal movement relative to the upper arm, but these prior art systems are quite complex, while others do not provide the easily manipulatable positive locking means of the present invention.

For example, U.S. Pat. No. 3,830,336 discloses a crane device provided with a hydraulic brake device, which is used for braking the bucket or receptacle against movement when the boom arms have reached a selected position. This brake device is mounted on a metal hanger assembly and a pair of brake pads are urged into braking relation with a brake plate by means of a helical spring. Hydraulic pressure is used to release the brake when it is desirable to pivot the bucket.

U.S. Pat. No. 3,043,394 discloses a manually operable screw and nut type arrangement for clamping the bucket or receptacle in a locked position. Specifically, when a threaded bolt having a bead thereon is rotated in one direction, the bead on the threaded bolt cooperates with a tubular member to compress a lock washer into friction engagement with the boom arm to lock the bucket against movement.

U.S. Pat. No. 3,653,461 discloses a rotary dampener for a personnel bucket of a crane and includes a hydraulic piston and cylinder unit interposed between the supporting strut and the bucket. A piston is secured to the piston rod, the latter being provided with threads at its outer ends so that, as the bucket rotates, the piston body will be moved in an axial direction and will be resisted by fluid located in the cylinder.

U.S. Pat. No. 3,286,855 discloses a crane having a personnel bucket which is pivotally connected to the crane boom by a gimbel or pivot shaft. The personnel buckets may be locked in an adjusted position by a pair of clamping screws which prevent relative movement between the bucket and shaft.

U.S. Pat. No. 4,537,281 discloses an aerial platform provided with a manually operable brake device which releasably retains the aerial bucket in an adjusted position.

SUMMARY OF THE INVENTION

It is an object of this invention to provide a novel locking mechanism for a crane device in which the locking mechanism is located adjacent the operator supporting bucket and which is operable to readily lock the bucket against pivotal movement relative to the upper boom arm of the crane. These and other objects of the invention will be more fully defined in the following Specification.

FIGURES OF THE DRAWING

DESCRIPTION OF THE PREFERRED EMBODIMENT

Figure 1:
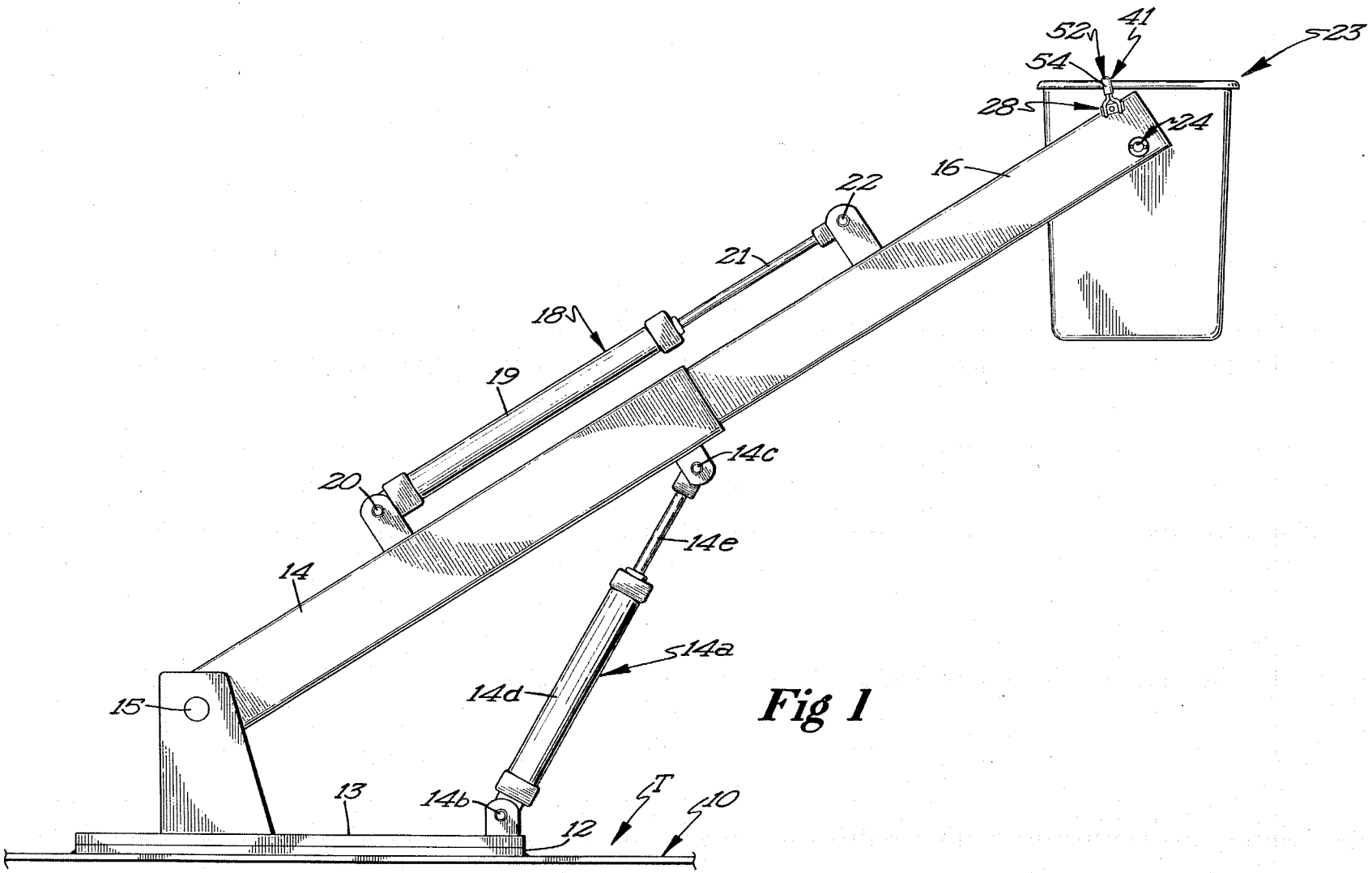
FIG. 1 is a side elevational view of a crane incorporating the novel locking mechanism mounted on a conventional vehicle.

Referring now to the drawings and, more specifically, to FIG. 1, it will be seen that a crane 11 is mounted on a truck bed 10 of a conventional truck T. The crane device includes a mounting plate 12 which is secured to the truck bed and to which is mounted a turntable 13. Although not shown in the drawing, means are provided for rotating the turntable about a vertical axis to permit the crane device to be rotated in a well-known manner.

The crane device also includes a lower boom arm 14 which is pivotally connected to the turntable 13 by a pivot 15. A hydraulic piston and cylinder unit **14*a* includes a cylinder 14*d* which is pivotally connected to the turntable 12 by a pivot 14*b*. The hydraulic unit 14 also includes a piston rod 14*e* which is pivoted to the lower boom arm 14** so that extension and retraction of the piston and cylinder unit raises and lowers the lower boom arm.

The lower boom arm telescopically receives an elongate upper boom arm 16 therein. A piston and cylinder unit 18 includes a cylinder 19 pivotally connected by a pivot 20 to the lower boom arm 14. The piston and cylinder unit 18 also includes a piston rod 21 which is pivotally connected by a pivot 22 to the upper boom arm 16. It will be seen that, when the piston and cylinder unit 18 is extended and retracted, the upper boom arm 16 will also be extended and retracted relative to the lower boom arm 14.

The upper end portion of the upper boom arm is pivotally connected by a pivot 22 to a bucket or receptacle 23. The bucket or receptacle 23 is adapted to contain an occupant during operation of the crane device. It is also pointed out that the bucket 23 freely pivots relative to the upper boom arm 16 during movement of the crane.

Figure 2:
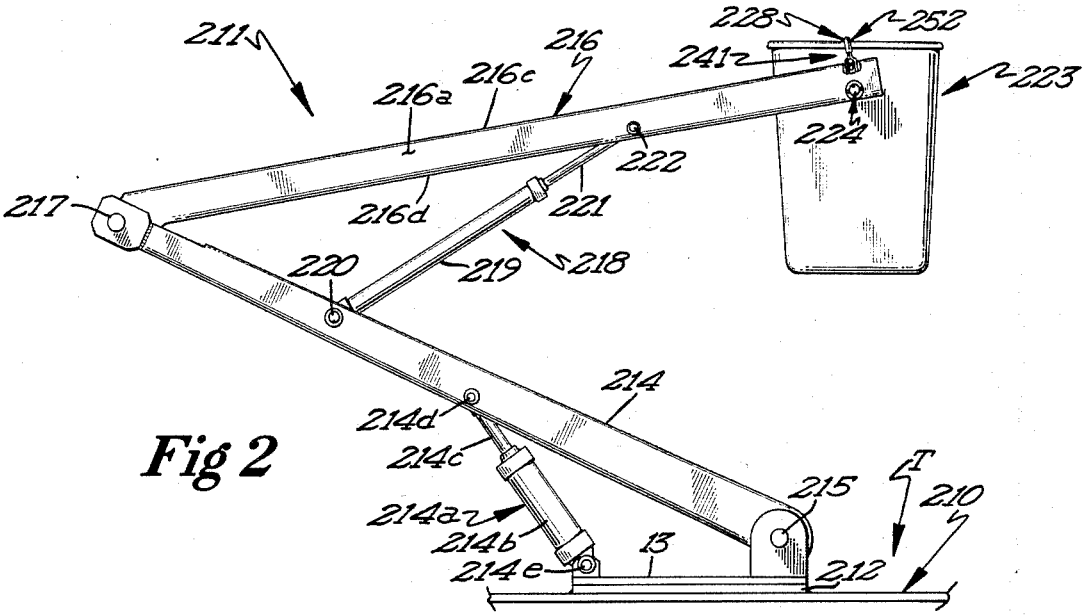
FIG. 2 is a side elevational view of a different crane using the locking mechanism in conjunction with the occupant bucket.

Referring now to FIG. 2, it will be seen that the pivot 24 constitutes an elongate pin which projects through openings in the side walls **16*a* and 16*b* of the upper boom arm 16. The inner surface of each side wall 16*a* and 16*b* of the upper boom arm 16 is provided with one of a pair of bearings 27 in which the pivot 24 is journaled. One end of the pivot projects into a sleeve 26 which is integral with a plate 25 secured to the bucket 23. The pivot 24 is rigidly affixed to the sleeve 26 by means of locking pin 24*a* so that the bucket rotates with the pivot 24, while the other end projects through side wall 16***a* and is held in position by means of another locking pin 24*a*. It will also be seen that the upper boom arm 16, which is of rectangular cross-sectional configuration, also includes a top wall 16*c* and a bottom wall 16*d*.

A lock mechanism, designated generally by the reference numeral 28, is provided for releasably locking the pivot pin 24 and the bucket 23 in an adjusted position. Referring again to FIG. 2, it will be seen that the pivot pin 24 is provided with a keyway 29 into which is positioned a key 30. The key 30 also projects into a keyway 32 of a sleeve 31 positioned around the pivot pin 24. It will, therefore, be seen that the sleeve 31 is keyed to the cylindrical pivot pin 24 for movement therewith.

The sleeve 30 is provided with an enlarged cylindrical central portion 33 which projects readily outwardly therefrom. The enlarged central portion 33 has a flat sector plate 34 rigidly secured thereto and projecting therefrom A second sector plate 35, identical in configuration and size, is also rigidly affixed to the enlarged central portion 33 so that the sector plates 34 and 35 are disposed in substantially parallel spaced apart relation. It will be noted that sector plate 34 has a plurality of openings 34*a* therein adjacent the arcuate edge 34*b* thereof. The openings 34 are arranged in an arcuate pattern for a purpose to be described more fully hereinbelow. However, it will be noted that, when the pivot pin 24 rotates in the bearings 27, the sector plates 34 and 35 will move in unison therewith.

A generally rectangular shaped mounting bracket 36 is rigidly affixed to the inner surface of one of the side walls 16*b* by means of bolts 36*a* and one end portion of an elongate substantially rectangular shaped flat clamping plate 37 is rigidly affixed to the bracket. A small generally rectangular shaped flat connecting plate 38 is rigidly affixed to the upper edge of the clamping plate 37, as by welding. The connecting plate 38 is also rigidly secured to the upper edge of a pair of elongate substantially rectangular shaped similar clamping plates 39 and 40 adjacent one end of the plates. The plates 39 and 40 are also substantially identical in shape and size to the plate 37, and it will be noted that plate 39 is spaced along and substantially parallel to plate 37. Similarly, plate 40 is laterally spaced from and is substantially parallel to plate 39.

In the embodiment shown, the sector plate 34 is positioned between the clamping plates 39 and 40, while the sector plate 35 is positioned between the clamping plates 37 and 38. It will also be noted that clamping plate 40 has an opening 40*a* therein which corresponds in size to each opening 34*a* in the sector plate 34.

Figure 3:
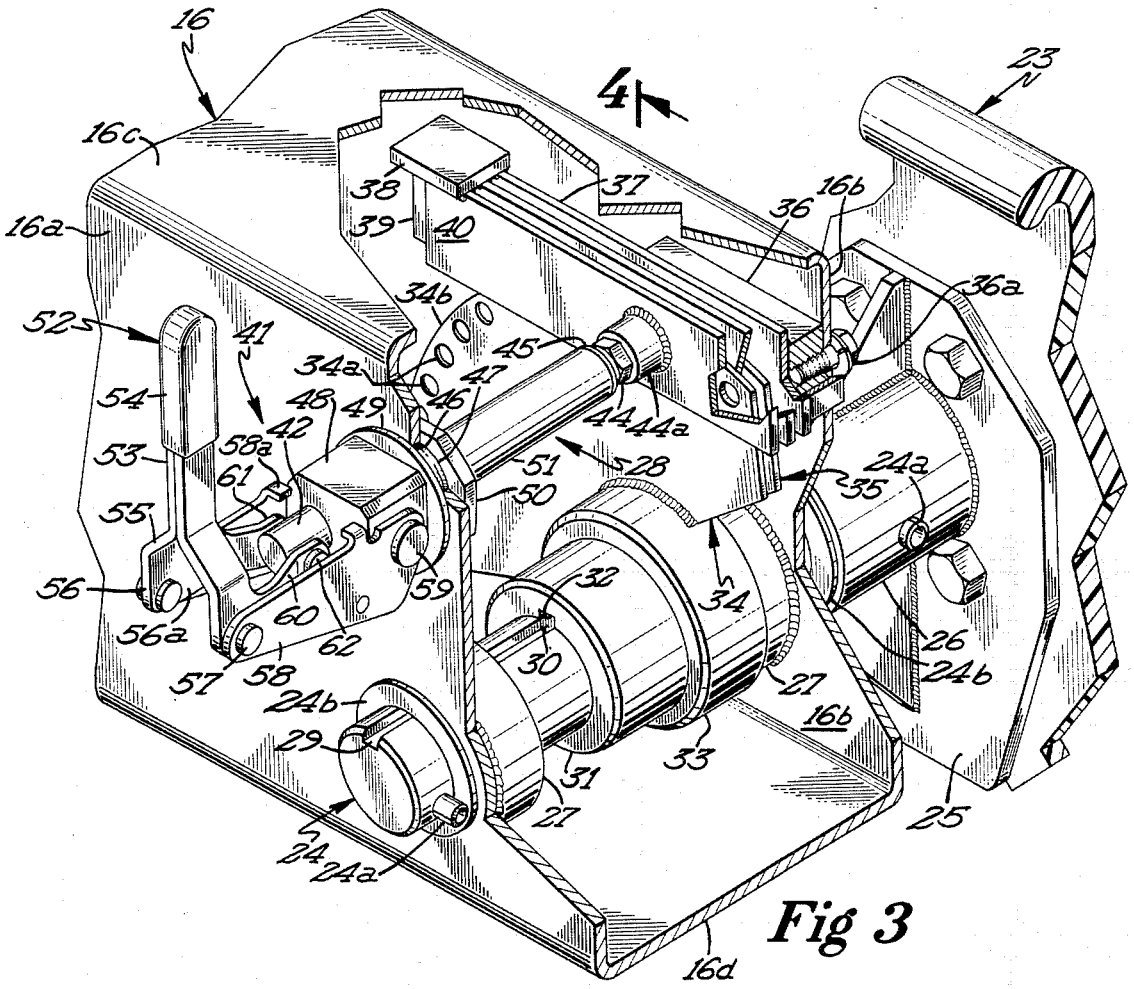
FIG. 3 is an enlarged perspective view of a portion of the crane illustrating the details of construction of the novel locking mechanism.
Figure 4:
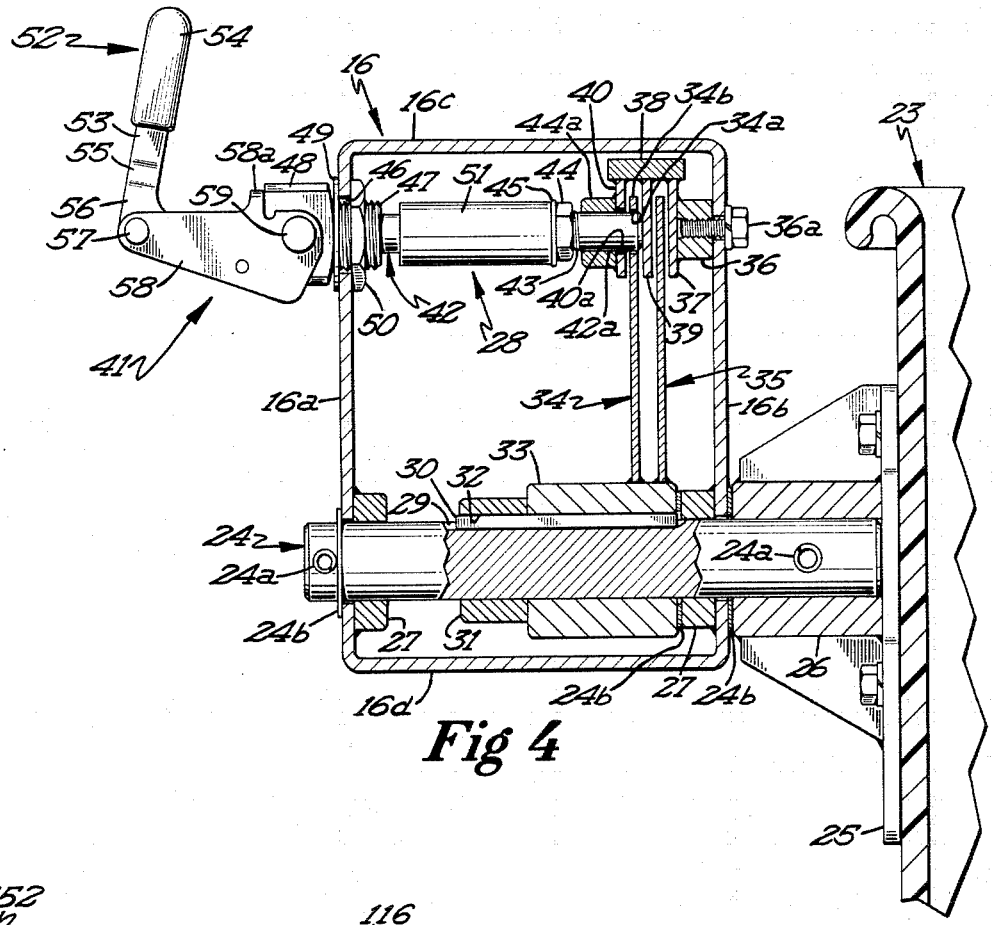
FIG. 4 is a cross-sectional view taken approximately along the line 4—4 of FIG. 3 and looking in the direction of the arrows.

Means are provided for shifting the clamping plates 37, 39, and 40 into clamped relation with respect to the sector plates 34 and 35. This means includes an actuating mechanism 41 comprising an elongate locking bolt 42 which projects through an opening 46 in the side wall 16*a* of the upper boom arm 16, which is remote from the bucket 23. The elongate locking bolt 42 has a reduced threaded end 43 upon which is threaded a nut 44, as best seen in FIGS. 3 and 4. A washer 45 is clamped against this end by the nut 44. A guide sleeve 44*a* is rigidly secured to the clamping member 40 and is disposed in registering relation with the opening 40*a* therein. The reduced end portion 42*a* of the locking bolt 42 is adapted to project through the guide sleeve 44*a* and into the opening 40*a* in the clamping plate 40 when the locking bolt is in the release position. However, when the locking bolt 42 is shifted to the locking position, the reduced end portion 42*a* of the locking bolt will project through a selected opening 34*a* of the sector member 34 to lock the bucket 23 against pivotal movement relative to the upper boom arm 16.

The locking bolt 42 projects through a block 48 positioned exteriorly of the wall 16*a*. The block has a reduced external extension 47 which projects through the opening 46 in the side wall 16*a*. A washer 49 is positioned around the reduced extension 47 and is interposed between the block and the side wall 16*a*. A nut 50 threadedly engages the reduced extension 47 and engages the interior surface of the wall 16*a*. A spacer sleeve 51 is positioned between the end of the reduced extension 47 and the washer 45, as best seen in FIG. 3. It will also be noted that the locking bolt 42 is slidable in the block 48 and the reduced extension 47 thereof.

An actuating handle 52 is interconnected to the locking bolt 42 for shifting the latter between locking and release positions. The actuating handle 52 is axially comprised of a pair of handle members which are mirror images of each other and each includes a straight hand grip portion 53, which is rigidly or otherwise secured to the hand grip portion of the other handle member. A plastic gripping cover 54 is positioned over the end portion of the straight hand grip portion 53.

The handle member also includes a pair of diverging portions 55, each of which are integral with one of a pair of straight portions 56. The straight portions are bent at right angles, as at 56*a*, which are integral with offset portions 60 that terminate in straight portions 61. The straight portions 61 are pivotally connected to the end portion of the locking bolt 42 by a pivot 62.

The straight portions 56 of each handle member are pivotally connected to one end of a pair of elongate links 58 by a pivot 57. The other end of each of the links 58 is pivotally connected by a pivot 59 to the block 48. It will be seen that links 58 each have an internal tab 58*a* intermediate their ends projecting from the top edge thereof, as seen in FIG. 2. The tabs 58*a* actually constitute stop members and engage the surface of the block 48 when the locking bolt is shifted to the lock position to limit further movement of the bolt.

During operation of the lock 28, the lock device will be in the unlocked position as the crane device is maneuvered to a selected position. When the lock mechanism 28 is in the release condition, the locking bolt 42 will be retracted and the handle 52 will likewise be moved away from the adjacent side wall 16*a* of the upper boom arm 16. It will be noted that the lock device is closely adjacent the bucket 23 so that an operator may readily grip the handle 52 and shift the lock device between locked and release positions. Further, the controls for the crane, also located in the bucket 23, can permit the operator to maneuver the crane device in a well-known manner. After the crane device has been maneuvered to position the bucket in the desired position, the operator will then grip the actuating handle 52 and shift the handle in a locking direction. This shifts the locking bolt 42 so that the reduced end portion will be moved through the opening 40*a* in through one of the openings 34*a* in the sector plate 34. Further movement of the locking bolt causes the plates 40, 39, and 37 to be clamped against the sector plates 34 and 35 to lock the bucket 23 in the selected position. It is pointed out that the compression of the clamping plates 40, 39, and 37 against the sector plates is sufficient to lock the bucket 23 against pivoting movement relative to the upper boom arm. The use of a bolt projecting through a selected opening in the sector plate 34 provides a positive lock against movement.

Figure 5:
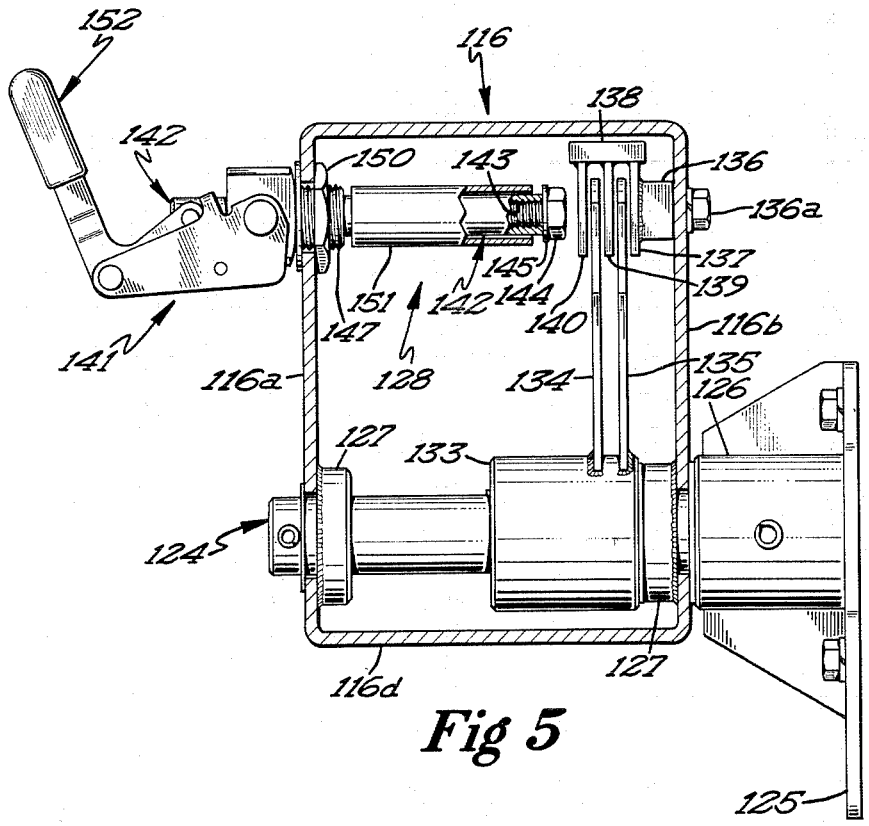
FIG. 5 is a cross-sectional view of a portion of the crane device similar to FIG. 4 and illustrating a different embodiment of the locking device.

Referring now to FIG. 5, it will be seen that a slightly different embodiment of the locking device is thereshown. The locking mechanism, designated generally by the reference numeral 128, is substantially identical in most respects with respect to locking mechanism 28. The locking mechanism includes an elongate locking bolt 142, which has a tapped hole 143, which is threadedly engaged by a bolt 144. A suitable washer 145 is interposed between the shoulder defined by the end portion of the locking bolt 142 and the bolt 144. A spacer sleeve 151 is also provided, but is identically placed with respect to the spacer sleeve 151. The actuating handle 152 is also identical in construction and the manner in which it is interconnected with the locking bolt to that of the embodiment of FIG. 2.

It will be noted that the sector plate 134 is positioned between the clamping plates 140 and 139, while the sector plate 135 is positioned between the clamping plates 139 and 137. The three clamping plates are also rigidly secured together by connecting plate 138, and the clamping plate 137 is secured to a mounting bracket 136, which is affixed to one of the side walls 116*a* by bolts 136*a*. It will also be note that the sector plate 134 does not have the openings therein in the manner of the sector plate 34 of the embodiment of FIGS. 1–4. Further, the clamping plate 140 does not contain an opening therethrough in the manner of the clamping clamping plate 44 of the embodiment of FIG. 2. Otherwise, the locking device 128 is identical in all other respects respects to the locking mechanism 28 of the embodiment of FIG. 2.

When the locking mechanism 128 is actuated to the locked position, the locking bolt 142 will be advanced to progressively clamp the clamping plates 140, 139, and 137 against the sector plates 134 and 135. This locks the sector plates and the pivot pin 124 against movement relative to the upper boom arm 116. Because of the over-center locking arrangement of the actuating handle 152 (as well as locking handle 52), the lock mechanism 128 will be retained in the locked position until the actuating handle is shifted to the release position. It will, therefore, be seen that the lock mechanism 128 also provides an effective locking means for locking the bucket against movement relative to the upper boom arm 16.

Referring now to FIG. 2, it will be seen that the novel locking mechanism has been illustrated and incorporated on a different style crane. The crane illustrated in the embodiment of FIGS. 1, 3, and 4, as well as the different embodiment of the locking mechanism illustrated in FIG. 5, relate to a telescoping type crane, which may be mounted on a suitable vehicle, such as a pickup truck or the like. The crane illustrated in the embodiment of FIG. 2 is a knuckle boom type crane in which the lower boom arms pivot relative to each other. In this regard, the crane device illustrated in FIG. 2 is designated generally by the reference numeral 211 and is mounted on a truck bed 210 of a conventional truck T. The crane device also includes a mounting plate 212, which is secured to the truck bed, and which includes a turntable 213. Although not shown in the drawing, means are provided for rotating the turntable about a vertical axis to permit the crane device to be rotated in a well-known manner.

The crane device 211 also includes a lower boom arm 214, which is pivotally connected to the turntable 213 by a pivot 215. A hydraulic piston and cylinder unit 214*a* includes a cylinder 214*b*, which is pivotally connected to the turntable 212 by a pivot 214*e*. The hydraulic unit 214*a* also includes a piston rod 214*c*, which is affixed to the piston movable in the cylinder 214*b*, and which is also pivotally connected to the lower boom arm 214 by a pivot 214*d*. It will be seen that extension and retraction of the piston and cylinder unit 214*a* raises and lowers the lower boom arm 214.

The upper end portion of the lower boom arm 214 is pivotally connected by a pivot 217 to an elongate upper boom arm 216. A piston and cylinder unit 218 includes a cylinder 219 pivotally connected by a pivot 220 to the lower boom arm 214. The piston and cylinder unit 218 also includes a piston rod 221, which is pivotally connected by a pivot 222 to the upper boom arm 216. It will be seen that, when the piston and cylinder unit 218 is extended and retracted, the upper boom arm 216 will be raised and lowered relative to the lower boom arm 214.

The upper end portion of the upper boom arm is pivotally connected by a pivot 222 to a bucket or a receptacle 223. It is pointed out that a lock mechanism 228 identical to that shown in FIGS. 1, 3, and 4 is provided for releasably locking the bucket in an adjusting position. Therefore, details of construction of the lock mechanism for this style of crane are thought to be unnecessary. It is also pointed out that the lock mechanism illustrated in FIG. 5 may also be incorporated in conjunction with the embodiment of FIG. 2.

From the foregoing, it will be seen that I have provided a novel lock mechanism for a crane device, which is not only of simple and inexpensive construction, but one which effectively locks the occupant supporting bucket against movement when the latter has been shifted to a selected position.

What is claimed is:

1. In combination with a truck mounted crane apparatus including an elongate telescopically extensible and retractable boom structure including elongate hollow lower and upper boom arms, means at one end of the lower boom arm connecting the latter to the bed of the truck to permit pivoting movement of the lower boom are relative to the truck bed, a receptacle for supporting an occupant therein, pivot means pivotally connecting the receptacle to the upper boom arm and including an elongate pivot axle having one end thereof secured to the receptacle, said pivot axle extending through and being journaled on the upper end of the upper boom arm to permit pivotal movement of the receptacle relative to the boom structure, a locking mechanism including a pair of laterally spaced apart sector plates, each being affixed to said pivot axle for rotation therewith and positioned within the upper boom arm, one of said sector plates having a plurality of openings therein, a plurality of clamping elements positioned within said upper boom arm and affixed thereto, said sector plates being disposed in interdigitating relation with respect to the clamping elements, one of said locking elements having an opening therein, an elongate locking bolt shiftably mounted on and projecting into said upper boom arm adjacent said receptacle and being shiftable between an advanced locking position towards said sector plates and clamping elements, and a retracted release position in a direction away from said sector plates and clamping elements, said locking bolt, when shifted to the advance locking position, extending through the opening in said one of said clamping elements and through a selected opening in said one sector plate to lock the pivot axle and receptacle against pivotal movement relative to the boom structure, and, when in the retracted position, being released from the openings in said sector plate and clamping elements, and an actuating handle connected with said locking bolt for shifting the same between locking and release positions.

2. The invention as defined in claim 1 wherein said openings in said one sector plate are arranged in an arcuate pattern.

* * * * *